US011024259B2

(12) United States Patent
Chu et al.

(10) Patent No.: US 11,024,259 B2
(45) Date of Patent: Jun. 1, 2021

(54) PIXEL COMPENSATION METHOD, PIXEL COMPENSATION APPARATUS AND PIXEL COMPENSATION SYSTEM

(71) Applicant: BOE TECHNOLOGY GROUP CO., LTD., Beijing (CN)

(72) Inventors: Mingi Chu, Beijing (CN); Fei Yang, Beijing (CN); Yi Chen, Beijing (CN); Yu Wang, Beijing (CN); Lirong Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 84 days.

(21) Appl. No.: 16/428,429

(22) Filed: May 31, 2019

(65) Prior Publication Data

US 2020/0152154 A1 May 14, 2020

(30) Foreign Application Priority Data

Nov. 8, 2018 (CN) ..... 201811327531.6

(51) Int. Cl.
*G09G 5/10* (2006.01)
*G09G 3/20* (2006.01)
*G09G 3/3208* (2016.01)

(52) U.S. Cl.
CPC ..... *G09G 5/10* (2013.01); *G09G 3/2003* (2013.01); *G09G 3/3208* (2013.01);
(Continued)

(58) Field of Classification Search
CPC .. G09G 3/2003; G09G 3/3208; G09G 3/3233; G09G 5/10; G09G 2320/0233;
(Continued)

(56) References Cited

U.S. PATENT DOCUMENTS

2014/0055500 A1* 2/2014 Lai ..... G09G 3/3225 345/690
2016/0379551 A1 12/2016 Zhuang et al.
(Continued)

FOREIGN PATENT DOCUMENTS

CN 104867449 A 8/2015
CN 105096829 A 11/2015
(Continued)

OTHER PUBLICATIONS

First Chinese Office dated Dec. 11, 2019, received for corresponding Chinese Application No. 201811327531.6, 18 pages.

*Primary Examiner* — Stacy Khoo
(74) *Attorney, Agent, or Firm* — Kinney & Lange, P.A.

(57) ABSTRACT

A pixel compensation method, a pixel compensation apparatus and a pixel compensation system are disclosed. The pixel compensation method includes: sampling pixel values of an image to be displayed on a display screen to obtain target sampling data; transmitting the target sampling data; receiving pixel compensation data, wherein the pixel compensation data is determined according to an aging duration of the display screen which is determined based on the target sampling data; and compensating for the pixel values of the image to be displayed on the display screen based on the pixel compensation data. The pixel compensation method includes: receiving target sampling data obtained by sampling pixel values of an image to be displayed on a display screen; determining an aging duration of the display screen based on the target sampling data; determining pixel compensation data based on the aging duration; and transmitting the pixel compensation data.

15 Claims, 6 Drawing Sheets

(52) U.S. Cl.
CPC ..... *G09G 2320/0233* (2013.01); *G09G 2320/0242* (2013.01); *G09G 2320/0257* (2013.01); *G09G 2320/045* (2013.01); *G09G 2320/048* (2013.01); *G09G 2320/0626* (2013.01); *G09G 2320/0666* (2013.01)

(58) Field of Classification Search
CPC ... G09G 2320/0242; G09G 2320/0257; G09G 2320/045; G09G 2320/048; G09G 2320/0626; G09G 2320/0666
See application file for complete search history.

(56) References Cited

U.S. PATENT DOCUMENTS

| | | | | |
|---|---|---|---|---|
| 2017/0110069 | A1* | 4/2017 | Shoshan | G09G 3/3413 |
| 2018/0308405 | A1 | 10/2018 | Chaji et al. | |
| 2019/0066575 | A1 | 2/2019 | Song | |

FOREIGN PATENT DOCUMENTS

| | | | |
|---|---|---|---|
| CN | 107424561 | A | 12/2017 |
| CN | 107909964 | A | 4/2018 |

* cited by examiner

PIXEL COMPENSATION METHOD, PIXEL COMPENSATION APPARATUS AND PIXEL COMPENSATION SYSTEM

CROSS-REFERENCE TO RELATED APPLICATION(S)

The present application claims priority to the Chinese Patent Application 201811327531.6, filed on Nov. 8, 2018, which is incorporated herein by reference in its entirety.

TECHNICAL FIELD

The present disclosure relates to the field of display technologies, and more particularly, to a pixel compensation method, a pixel compensation apparatus, and a pixel compensation system.

BACKGROUND

A display screen, such as an Organic Light-Emitting Diode (OLED for short) display screen, comprises circuits and display devices, etc. The display screen may age for a variety of reasons. For example, an organic display device usually comprises an organic material, which may gradually age in an irreversible way as the use time increases, and thereby the display screen ages. The aged display screen has a degraded uniformity in displaying, and display problems such as afterimages etc. may even occur with the aging.

SUMMARY

The embodiments of the present disclosure provide a pixel compensation method, a pixel compensation apparatus, and a pixel compensation system.

According to a first aspect of the present disclosure, there is provided a pixel compensation method, comprising:

sampling pixel values of an image to be displayed on a display screen to obtain target sampling data;

transmitting the target sampling data;

receiving pixel compensation data, wherein the pixel compensation data is determined according to an aging duration of the display screen which is determined based on the target sampling data; and compensating for the pixel values of the image to be displayed on the display screen based on the pixel compensation data.

In an example, sampling pixel values of an image to be displayed on a display screen to obtain target sampling data comprises: for at least one frame of image to be displayed, partitioning each of the at least one frame of image into m regions, where m is a positive integer; and sampling pixel values of at least a portion of pixel points in each of the regions of each frame of image to obtain the target sampling data.

In an example, the pixel compensation data comprises an adjustment factor, and compensating for the pixel values of the image to be displayed on the display screen based on the pixel compensation data comprises: for at least one frame of image to be displayed, adjusting pixel values of pixel points of each of the at least one frame of image using the adjustment factor.

In an example, the target sampling data comprises pixel values of sub-pixel points of different colors, the pixel compensation data comprises an adjustment factor for sub-pixel points of each of the different colors, and compensating for the pixel values of the image to be displayed on the display screen based on the pixel compensation data comprises: for each of the at least one frame of image to be displayed, adjusting pixel values of sub-pixel points of each color in the frame of image by using a respective adjustment factor.

In an example, before transmitting the target sampling data, the method further comprises: for each of the at least one frame of image, determining a target pixel value of the frame of image based on Average Pixel Luminance (APL) of the frame of image;

determining, based on a pre-established mapping of pixel value intervals to gain values, a gain value to which a pixel value interval where the target pixel value is located is mapped; and determining a product of each sampled pixel value of the frame of image and the determined gain value as the sampled pixel value to be included in the target sampling data.

In an example, the method further comprising: establishing a mapping of pixel value intervals to gain values by:

generating X pixel value intervals based on the highest pixel value of the image to be displayed, where X is an integer greater than 1; and mapping an $i^{th}$ one of the X pixel value intervals to a gain value of i/X, where i is an integer and $1 \leq i \leq X$.

In an example, the display screen is an Organic Light Emitting Diode (OLED) display screen, and the pixel values are luminance values or grayscale values.

According to a second aspect of the present disclosure, there is provided a pixel compensation method, comprising:

receiving target sampling data obtained by sampling pixel values of an image to be displayed on a display screen;

determining an aging duration of the display screen based on the target sampling data;

determining pixel compensation data based on the aging duration; and transmitting the pixel compensation data.

In an example, determining an aging duration of the display screen based on the target sampling data comprises:

determining an overall pixel value and a cumulative lighting duration of the sampled image based on the target sampling data; and determining the aging duration based on the overall pixel value and the cumulative lighting duration.

In an example, determining the aging duration based on the overall pixel value and the cumulative lighting duration comprises:

selecting a scaling factor based on the determined overall pixel value; and converting, by using the scaling factor, the determined cumulative lighting duration into a value in a value range suitable for a selected aging model as the aging duration.

In an example, the target sampling data comprises pixel values sampled from m regions in each of at least one frame of image to be displayed on the display screen and a sampling time for each of the at least one frame of image, where m is a positive integer, and determining an overall pixel value and a cumulative lighting duration of the sampled image based on the target sampling data comprises:

determining an overall pixel value for each of the at least one frame of image based on the pixel values sampled from the m regions of the frame of image, and determining the overall pixel value of the sampled image based on the overall pixel values determined for the at least one frame of image; and determining the cumulative lighting duration based on sampling times for the at least one frame of image.

In an example, determining an overall pixel value for each of the at least one frame of image based on the pixel values sampled from the m regions of the frame of image comprises:

performing weighted averaging on the pixel values sampled from the m regions to obtain the overall pixel value for the frame of image, wherein a weight of a region located at a center among the m regions is greater than that of a region located at an edge among the m regions.

In an example, determining pixel compensation data based on the aging duration comprises:

selecting an aging model based on the determined overall pixel value, wherein the aging model characterizes a relationship between aging durations and aging parameters for the determined overall pixel value;

querying the selected aging model based on the determined aging duration to obtain an aging parameter of the display screen; and determining an adjustment factor for adjusting the pixel values based on the obtained aging parameter.

In an example, the target sampling data comprises pixel values of sub-pixel points of different colors, and determining an aging duration of the display screen based on the target sampling data and determining pixel compensation data based on the aging duration are performed for sub-pixel points of each color.

In an example, the aging parameter represents a percentage of a decrease in pixel value.

In an example, the display screen is an Organic Light Emitting Diode (OLED) display screen, and the pixel values are luminance values or grayscale values.

According to a third aspect of the present disclosure, there is provided a pixel compensation apparatus, comprising:

a processor; and a memory having stored therein instructions executable by the processor, wherein the instructions which, when executed by the processor, cause the processor to perform the pixel compensation method according to the first aspect of the present disclosure.

According to a fourth aspect of the present disclosure, there is provided a pixel compensation apparatus, comprising:

a processor; and a memory having stored therein instructions executable by the processor, wherein the instructions which, when executed by the processor, cause the processor to perform the pixel compensation method according to the second aspect of the present disclosure.

According to a fifth aspect of the present disclosure, there is provided a pixel compensation system, comprising a display apparatus having a display screen and a compensation apparatus, wherein the display apparatus having the display screen comprises a first memory and a first processor, wherein the first memory has stored therein instructions executable by the first processor, wherein the instructions which, when executed by the first processor, cause the first processor to perform operations of:

sampling pixel values of an image to be displayed on the display screen to obtain target sampling data;

transmitting the target sampling data to the compensation apparatus;

receiving pixel compensation data from the compensation apparatus, wherein the pixel compensation data is determined according to an aging duration of the display screen which is determined based on the target sampling data; and compensating for the pixel values of the image to be displayed on the display screen based on the pixel compensation data, and the compensation apparatus comprises a second memory and a second processor, wherein the second memory has stored therein instructions executable by the second processor, wherein the instructions which, when executed by the second processor, cause the second processor to perform operations of:

receiving, from the display apparatus, the target sampling data obtained by sampling the pixel values of the image to be displayed on the display screen;

determining the aging duration of the display screen based on the target sampling data;

determining the pixel compensation data based on the aging duration; and transmitting the pixel compensation data to the display apparatus.

BRIEF DESCRIPTION OF THE DRAWINGS

In order to more clearly illustrate the embodiments of the present disclosure, the accompanying drawings to be used in the description of the embodiments will be briefly described below.

The accompanying drawings, which are incorporated in the specification and constitutes a part of the specification, illustrate the embodiments according to the present disclosure, and are used to explain the principle of the present disclosure together with the specification.

DETAILED DESCRIPTION

In order to make the purposes, technical solutions and advantages of the present disclosure more clear, the present disclosure will be further described in detail below with reference to the accompanying drawings. Obviously, the embodiments described are merely some of the embodiments of the present disclosure, instead of all the embodiments. All other embodiments obtained by those of ordinary skill in the art based on the embodiments of the present disclosure without any creative work fall within the protection scope of the present disclosure.

Figure 1:
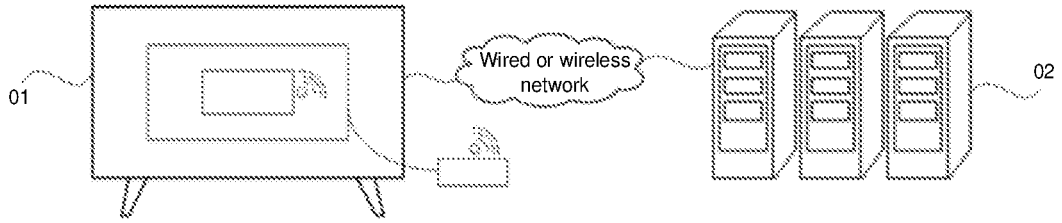
FIG. 1 is a schematic diagram of a pixel compensation system according to an embodiment of the present disclosure.

FIG. 1 is a schematic diagram of a pixel compensation system according to an embodiment of the present disclosure. As shown in FIG. 1, the pixel compensation system comprises a display apparatus 01 and a compensation apparatus 02. The display apparatus 01 and the compensation apparatus 02 may be communicatively connected by a wire or wirelessly. For example, the display apparatus 01 and the compensation apparatus 02 may be communicatively connected through a wired network, which comprises, but is not limited to, a Transmission Control Protocol/Internet Protocol (TCP/IP for short) network, a fiber network, or an InfiniB and (IB for short) network. For example, the display apparatus 01 and the compensation apparatus 02 may be communicatively connected through a wireless network, which comprises, but is not limited to, a Wireless Fidelity (WIFI for short) network, a 3rd-generation (3G for short) mobile communication technology network or a General Packet Radio Service (GPRS for short) network, etc.

The display apparatus 01 has a display screen, and is used to sample at least one frame of image to be displayed on the display screen to obtain target sampling data, and perform pixel compensation based on pixel compensation data transmitted by the compensation apparatus. For example, the at least one frame of image comprises one or more frames of image. For example, the sampling and compensation process may be implemented by a specified module in the display apparatus, wherein the specified module may comprise one or more of a graphics card, a Central Processing Unit (CPU for short), a timing controller, a computing chip, a System on Chip (SOC for short) or a Microcontroller Unit (MCU for short) integrated in the timing controller.

For example, the display apparatus may be a mobile phone, a tablet computer, an intelligent application device, a multimedia device, or a streaming device (for example, a video camera) etc. The display screen of the display apparatus comprises a plurality of display devices. For example, the display screen may be an OLED display screen, a Quantum Dot Light Emitting Diode (QLED for short) display screen, a Liquid Crystal Display (LCD for short) screen, or other display screens. For example, display devices of the OLED display screen are OLEDs, and display devices of the QLED display screen are QLEDs. Each of the display devices may be implemented as a respective sub-pixel point on the display screen.

The compensation apparatus 02 is used to process the target sampling data to obtain the pixel compensation data. For example, the compensation apparatus 02 may be a computer, or a server, for example, one server or a server cluster composed of several servers, or a cloud computing service center.

Figure 2:
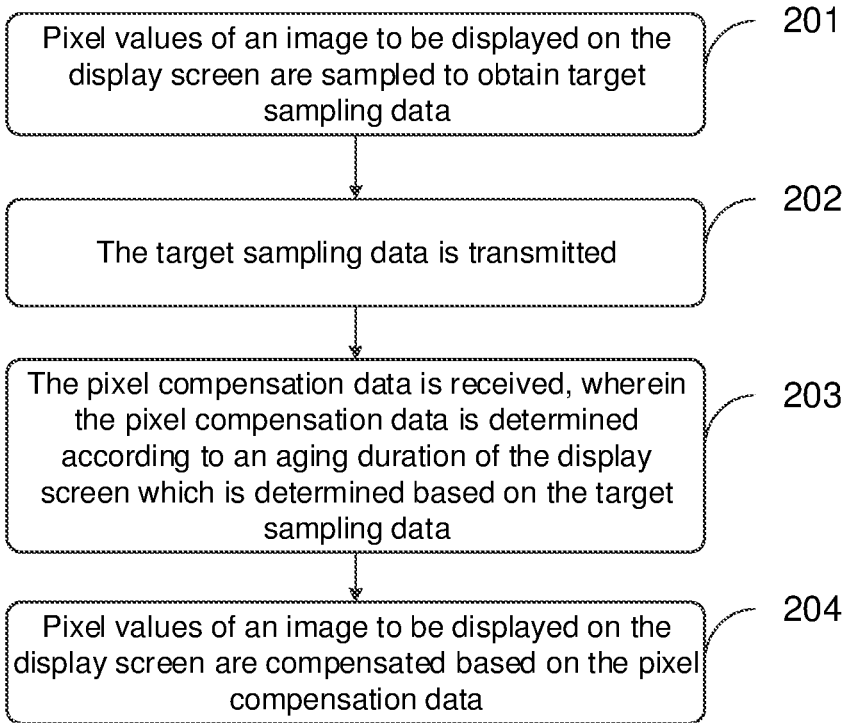
FIG. 2 is a flowchart of a pixel compensation method according to an exemplary embodiment.

FIG. 2 is a flowchart of a pixel compensation method according to an exemplary embodiment. The embodiment of the present disclosure is described by example of applying the pixel compensation method to the implementation environment shown in FIG. 1. This pixel compensation method may be performed by the above display apparatus.

In step 201, pixel values of an image to be displayed on the display screen are sampled to obtain target sampling data. For example, the display apparatus may sample pixel values of at least one frame of image (also referred to as a sampling frame image) to be displayed on the display screen to obtain target sampling data.

In step 202, the target sampling data is transmitted. For example, the display apparatus may transmit report data comprising the target sampling data to the compensation apparatus. The report data is used by the compensation apparatus to determine an aging duration of the display screen based on the target sampling data and then determine the pixel compensation data based on the aging duration.

In step 203, the pixel compensation data is received, wherein the pixel compensation data is determined according to an aging duration of the display screen which is determined based on the target sampling data. For example, as described above, the compensation apparatus may determine the aging duration of the display screen based on the target sampling data from the display apparatus and determine the pixel compensation data based on the aging duration.

In step 204, pixel values of an image to be displayed on the display screen are compensated based on the pixel compensation data. For example, after receiving the pixel compensation data transmitted by the compensation apparatus, the display apparatus may perform pixel compensation on at least one frame of image (also referred to as a target frame image) to be displayed on the display screen based on the pixel compensation data. Each target frame image and each sampling frame image may be the same frame of image to be displayed, or may be different frames of image to be displayed.

In summary, with the pixel compensation method according to the embodiment of the present disclosure, since the display apparatus may transmit the target sampling data to the compensation apparatus, the compensation apparatus obtains the pixel compensation data based on the target sampling data, and the display apparatus performs pixel compensation on the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

Figure 3:
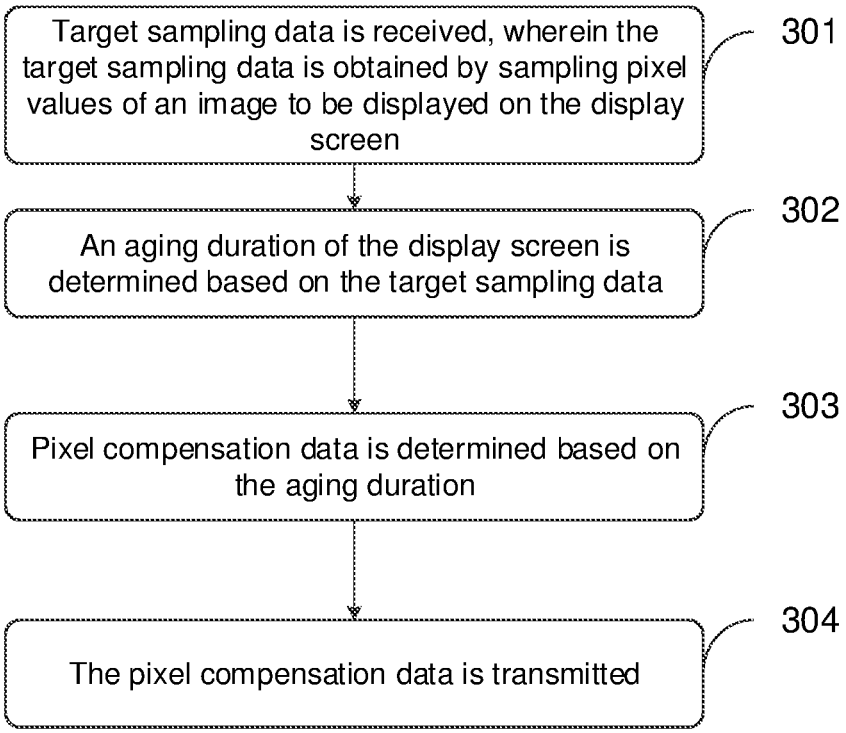
FIG. 3 is a flowchart of a pixel compensation method according to an exemplary embodiment.

FIG. 3 is a flowchart of a pixel compensation method according to an exemplary embodiment of the present disclosure. The embodiment will be described by example of applying the pixel compensation method to the implementation environment shown in FIG. 1. This pixel compensation method may be performed by the above pixel compensation apparatus.

In step 301, target sampling data is received, wherein the target sampling data is obtained by sampling pixel values of an image to be displayed on the display screen. For example, the compensation apparatus may receive report data comprising the target sampling data transmitted by the display apparatus, wherein the display apparatus has a display screen, and the target sampling data is obtained by the display apparatus sampling pixel values of at least one frame of image to be displayed on the display screen.

In step 302, an aging duration of the display screen is determined based on the target sampling data. For example, the compensation apparatus may determine the aging duration of the display screen based on the target sampling data.

In step 303, pixel compensation data is determined based on the aging duration. For example, the compensation apparatus may determine the pixel compensation data based on the aging duration.

In step 304, the pixel compensation data is transmitted. For example, the compensation apparatus may transmit the pixel compensation data to the display apparatus.

In summary, with the pixel compensation method according to the embodiment of the present disclosure, since the compensation apparatus may determine the pixel compensation data based on the target sampling data reported by the display apparatus, and the display apparatus performs compensation on the pixel values of the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

Figure 4:
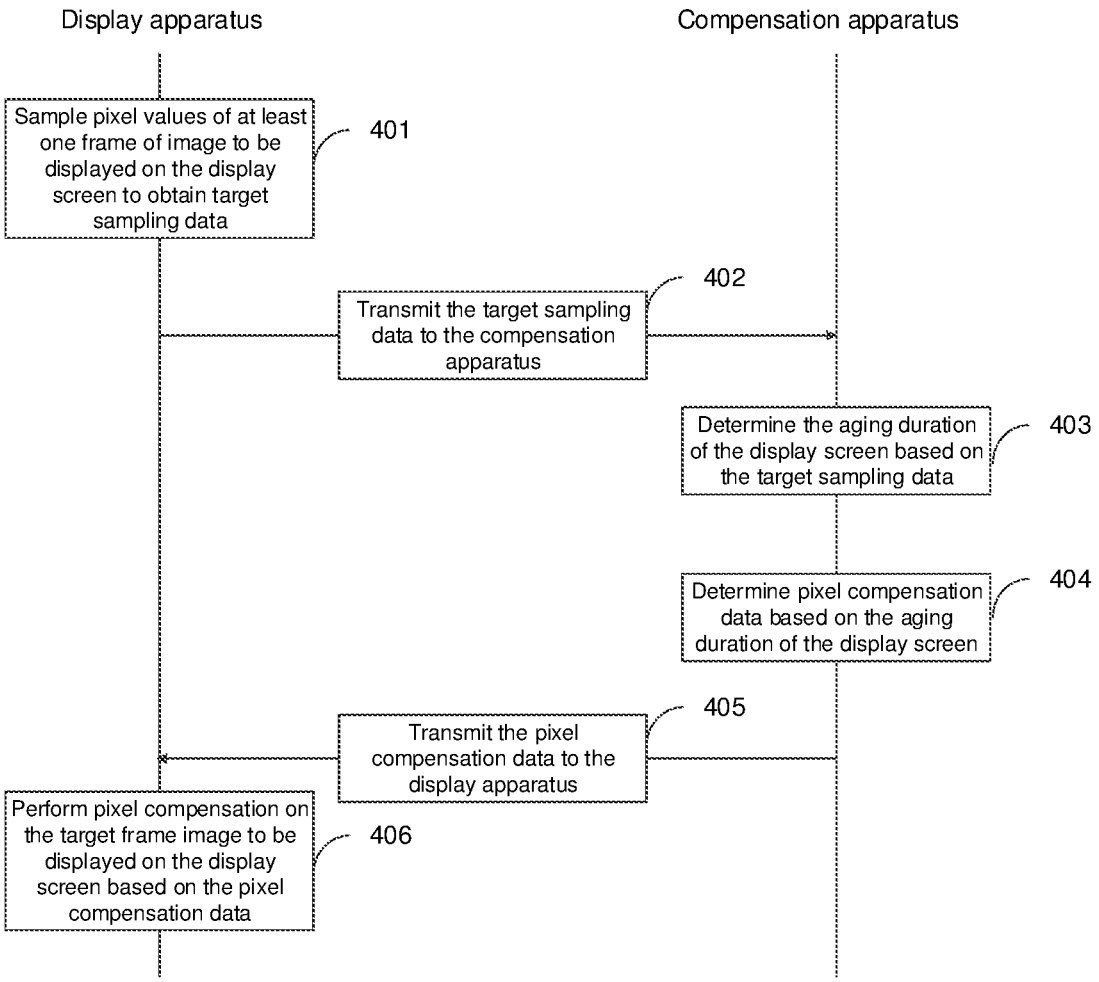
FIG. 4 is an interactive diagram of a pixel compensation method according to an exemplary embodiment.

FIG. 4 is an interactive diagram of a pixel compensation method according to an exemplary embodiment. The embodiment will be described by example of applying the pixel compensation method to the implementation environment shown in FIG. 1. The present embodiment is described by taking the display screen being an OLED display screen as an example.

The display apparatus may perform the same pixel compensation process on various frames of image to be displayed on the display screen. The present embodiment will be schematically described by taking one target frame image among images to be displayed on the display screen as an example, and pixel compensation processes of other target frame images may be performed with reference to the pixel compensation process of the target frame image.

In step 401, the display apparatus samples pixel values of at least one frame of image to be displayed on the display screen to obtain target sampling data.

For example, after the display screen is lit, the display apparatus may sample pixel values of one or more frames of image to be displayed on the display screen to obtain target sampling data. For example, when the display apparatus samples pixel values of a plurality of frames of image to be displayed on the display screen, the display apparatus may sample pixel values of a plurality of consecutive frames of image to be displayed on the display screen, or sample pixel values of a group of frames (i.e. the at least one frame of image, for example, the same number of frames of image are sampled each time) every a specified number of frames of image (that is, after a duration in which the display screen is not lit is removed, each two adjacent groups of sampled frames are separated by the specified number of frames).

It should be illustrated that the at least one frame of image to be displayed refers to an image which needs to be displayed currently. For example, the display apparatus may control display of images using a timing controller, and the display apparatus may sample at least one frame of image stored in the timing controller. In some embodiments, the timing controller may store one or two frames of image, and a current aging duration of the display screen may be determined based on sampling data of the last frame of image sampled by the display apparatus.

In the target sampling data obtained by sampling pixel values of each frame of image, a pixel value of each pixel point comprises pixel values of a plurality of sub-pixel points having different colors. In some embodiments, each pixel point may have a 3-color (for example, red, green, and blue) pixel structure, wherein the pixel point comprises a red sub-pixel, a green sub-pixel, and a blue sub-pixel. In some other embodiments, each pixel point may have a 4-color (for example, red, green, blue, and white) pixel structure, wherein the pixel point comprises a red sub-pixel, a green sub-pixel, a blue sub-pixel, and a white sub-pixel. Of course, each pixel point may have other pixel structures, which is not limited in the embodiments of the present disclosure.

The display apparatus may use the same sampling manner for various frames of image to be displayed on the display screen. For example, the display apparatus may perform regional or non-regional sampling on pixel values of each frame of image to be displayed on the display screen. In fact, the non-regional sampling may also be considered as a regional sampling in which the frame of image is partitioned into one region. When the display apparatus performs non-regional sampling on pixel values of each frame of image, the obtained target sampling data comprises pixel values of various pixel points (that is, all pixel points) of the frame of image. When the display apparatus performs regional sampling on pixel values of each frame of image, the obtained target sampling data comprises pixel values of a plurality of pixel points of the frame of image.

Figure 5:
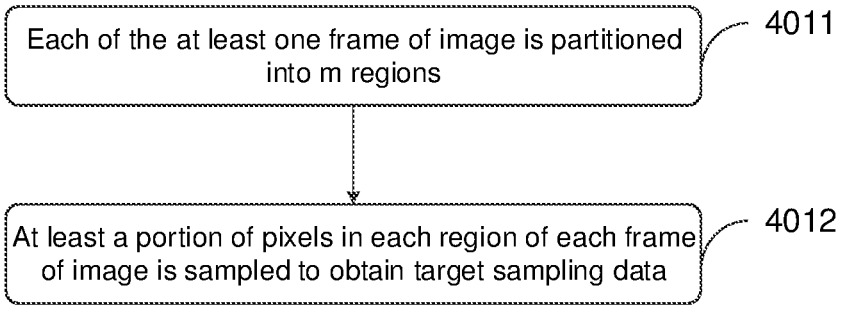
FIG. 5 is a flowchart of a partition sampling process according to an exemplary embodiment.

FIG. 5 is a flowchart of a partition sampling process according to an exemplary embodiment.

In step 4011, the display apparatus may partition each of the at least one frame of image into m regions in a specified partitioning manner, where m is a positive integer, and m regions usually refer to one or more regions, for example, m ranges from 10 to 100. Each of the above regions comprises at least one pixel point. There may be various specified partitioning manners, and the embodiment of the present disclosure will be described by taking the following three specified partitioning manners as an example.

Figure 6:
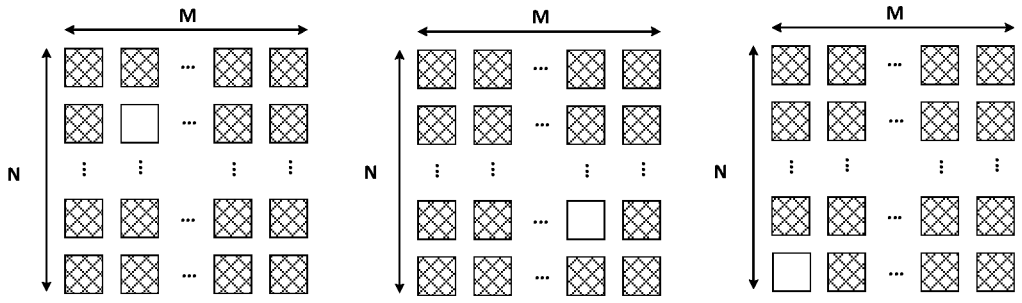
FIG. 6 is a schematic diagram of a region partitioning manner according to an exemplary embodiment.

For example, as shown in FIG. 6, the display apparatus may partition each frame of image into m regions arranged in an array. For example, each region may have a size of M*N pixel points, where $0<M<p$, wherein p is a value of a horizontal resolution of the display screen of the display apparatus, that is, a total number of pixel points in a row of pixel points of the display screen, and $0<N<q$, wherein q is a value of a vertical resolution of the display screen, that is, a total number of pixel points in a column of pixel points of the display screen, and M and N are positive integers. For example, M and N may have a value of 4.

Figure 7:
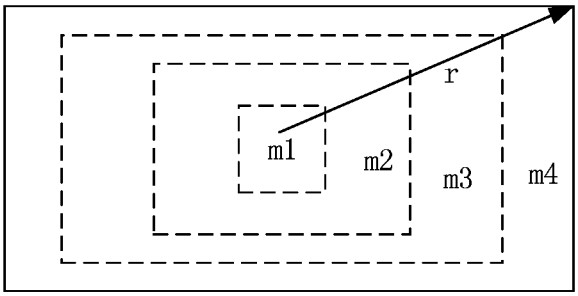
FIG. 7 is a schematic diagram of a region partitioning manner according to another exemplary embodiment.

As another example, as shown in FIG. 7, the display apparatus may partition each frame of image into m regions which are nested along a direction from a center to an edge, and the m regions are gradually increased in size along the direction, where m is usually an integer greater than 1. As an example, a region which is located at the center is a rectangular region, and regions outside the central region are rectangular annular regions. This makes it possible to distinguish images to be displayed at the visual center to the edge of the display screen. Optionally, any two adjacent regions have the same spacing. As shown in to FIG. 7, illustrated is an example in which the display apparatus partitions each frame of image into four regions ml to m4 in the direction (as indicated by an arrow r in FIG. 7) from the center to the edge.

Figure 8:
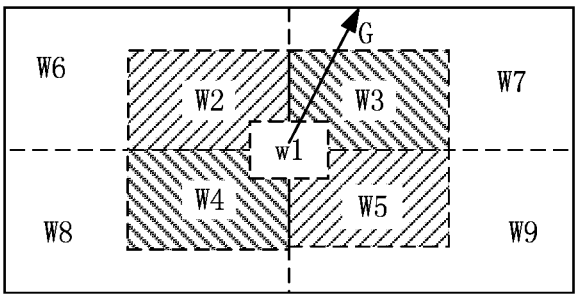
FIG. 8 is a schematic diagram of a region partitioning manner according to still another exemplary embodiment.

As still another example, as shown in FIG. 8, the display apparatus may partition each frame of image into m regions, where m may be an integer greater than 1, and the m regions may be gradually increased in size from a center to an edge of the image, that is, a size of a region close to the center of the image is less than that of a region away from the center of the image. In the present embodiment, a size of a region may be characterized by an area of the region or a number of pixels included in the region. As shown in FIG. 8, description is made by taking an example in which the display apparatus partitions each frame of image into nine regions W1 to W9, and the nine regions are gradually increased in size along the direction (as indicated by an arrow G in FIG. 8) from the center to the edge of the image. In some embodiments, the region partitioning may be performed according to a visual rule of human eyes, so that a sampling density of the central region is higher than that of the edge region, and thereby a part of the image to be displayed at the visual center is compensated with a higher precision that a part of the image in the edge region in subsequent pixel compensation.

It should be illustrated that the embodiment of the present disclosure is not limited to the above partitioning manner, and region partitioning may be performed in other manners.

In step 4012, the display apparatus samples at least a portion of pixels in each region of each frame of image to obtain target sampling data.

The target sampling data comprises sampling data in each of at least one frame of image, for example, sampling data in m regions of each frame of image. Each of the regions may comprise a plurality of pixel points, and pixel values of at least one pixel point (for example, w pixel points) of the plurality of pixel points in each region may be sampled, so that sampling data for each region may comprise pixel values of w pixel points, where w may be a specified number, which is a positive integer. The display apparatus may sample pixel values of w pixel points in each region randomly or in a specified order to obtain sampling data for the m regions.

Since pixel values of each two adjacent pixel points may not be significantly different from each other, pixel values of pixel points in the region may be reflected by sampling w pixel points in the region. This ensures the accuracy of the target sampling data, reduces a data amount of the target sampling data, and improves the operation efficiency.

It should be illustrated that the above pixel values may be grayscale values (also referred to as gray level values), luminance values or chromatic values. The embodiment of the present disclosure will be described by taking the pixel values being luminance values as an example.

Although the above embodiment has been described by taking an example in which each of the m regions is sampled, the sampling manner in the embodiment of the present disclosure is not limited thereto. For example, one or more regions may be selected from the m regions to be sampled. For each selected region, pixel values of all the pixels in the region may be sampled, or pixel values of some of the pixels in the region may be sampled.

In step 402, the display apparatus transmits the target sampling data to the compensation apparatus. The target sampling data is used by the compensation apparatus to determine an aging duration of the display screen and determine pixel compensation data based on the aging duration.

For example, the display apparatus may transmit report data comprising the target sampling data to the compensation apparatus through a wired or wireless network. For example, when the display apparatus is a television, the display apparatus may transmit the report data to the compensation apparatus through a television box (also referred to as a set top box) connected thereto.

The display apparatus may transmit the report data in real time, that is, each time the target sampling data is updated, the report data is transmitted to the compensation apparatus once. In some embodiments, considering that display devices in the display screen of the display apparatus have a relatively slow aging process, the display apparatus may periodically transmit the report data, that is, the display apparatus transmits the report data once each time the display screen has been lit for one report period. For example, the report period may be one day, two days, or seven days etc., as long as the report period is less than a cumulative aging duration of the display devices, which is not limited in the embodiments of the present disclosure.

In step 403, the compensation apparatus determines the aging duration of the display screen based on the target sampling data.

For example, an overall pixel value and a cumulative lighting duration of the sampled image may be determined based on the target sampling data, and the aging duration may be determined based on the overall pixel value and the cumulative lighting duration. In a case of the above regional sampling, the target sampling data comprises pixel values sampled from m regions in each of at least one frame of image to be displayed on the display screen and a sampling time for each of the at least one frame of image. The overall pixel value of each frame of image may be determined based on the sampled pixel values of the m regions of the frame of image, for example, by performing weighted averaging on the pixel values sampled from the m regions, in order to obtain the overall pixel value of the frame of image, wherein a weight of a region located at a center among the m regions may be greater than that of a region located at an edge among the m regions. An overall pixel value for the sampled image may be determined based on overall pixel values determined for the various frames of image. The cumulative lighting duration may be determined based on sampling times for the various frames of image.

In an embodiment of the present disclosure, the compensation apparatus may provide pixel compensation data to a plurality of display apparatuses to perform pixel compensation on the plurality of display apparatuses. Display screens of different display apparatuses may have different initial pixel values (for example, pixel values at the time of shipment), which are determined by various factors such as material properties of the display screens etc. In order to provide suitable pixel compensation data to each display apparatus and simplify a calculation process, an aging model may be preset, which characterizes a relationship between aging parameters of a display screen and aging durations of the display screen in a case of a specific pixel value (for example, a luminance value). In some embodiments, a plurality of aging models may be separately set for different color sub-pixels (for example, a red sub-pixel, a green sub-pixel, a blue sub-pixel, and a white sub-pixel in an OLED display screen) on the display screen, and each of the aging models is used to characterize a relationship between cumulative lighting durations (also referred to as cumulative aging durations) and aging parameters (also referred to as pixel indication values) when an initial pixel value of a respective color sub-pixel on the display screen is a specified pixel value. The plurality of aging models may have the same initial pixel value.

In some embodiments, after an aging model is selected, a scaling factor may further be selected based on the determined overall pixel value and the determined cumulative lighting duration may be converted into a value in a value range suitable for the selected aging model using the scaling factor as the aging duration to be used in a subsequent step 404. For example, a respective scaling factor may be selected based on a look-up table according to the overall pixel value and the determined cumulative lighting duration (i.e., the actual aging duration) may be converted into a value (i.e., a cumulative aging duration suitable for the aging model) in a value range suitable for the selected aging model using the selected scaling factor as the aging duration to be used in the subsequent step 404. The scaling factor may be a weight, and the cumulative lighting duration may be converted into the value in the value range suitable for the selected aging model by multiplying the cumulative lighting duration with the weight. For example, the compensation apparatus may convert the actual aging duration (for example, a cumulative lighting duration obtained by analyzing the target sampling data from the display screen or a cumulative lighting duration included in report data received from the display screen) of the display screen into the cumulative lighting duration (also referred to as the cumulative aging duration) suitable for the aging model based on the target sampling data, so as to determine the aging parameter of the display screen using the cumulative aging duration according to the aging model. For different display screens, actual aging durations thereof may be converted into cumulative aging durations suitable for respective aging models, thereby simplifying the subsequent calculation process.

The above embodiment has been described by taking an example in which the overall pixel value and the aging duration of the sampled image are calculated, but the embodiment of the present disclosure is not limited thereto. In some embodiments, aging durations may also be calculated separately for a part of pixels or sub-pixels in the image, or aging durations may be calculated separately for different types of sub-pixels.

For example, when the compensation apparatus is used to compensate for a display screen having a four-color (red, green, blue, and white) sub-pixel structure, the compensation apparatus stores four aging models for red, green, blue, and white sub-pixel points respectively. For the aging model for the red sub-pixel point, it is assumed that an initial pixel value (for example, a luminance value) of the aging model is 10000 nits. The aging model is used to characterize a relationship between cumulative aging durations of a display device where the red sub-pixel point is located and pixel indication values of the red sub-pixel point when the initial luminance of the red sub-pixel point is 10000 nits. The pixel indication value is used to identify a pixel value after the aging, or the pixel indication value may be the pixel value after the aging, or may be a ratio of the pixel value after the aging to a specified pixel value, or may be a ratio of a decrease of the pixel value after the aging relative to the specified pixel value to the specified pixel value, as long as it may reflect a current degree of aging of the display device.

Figure 9:
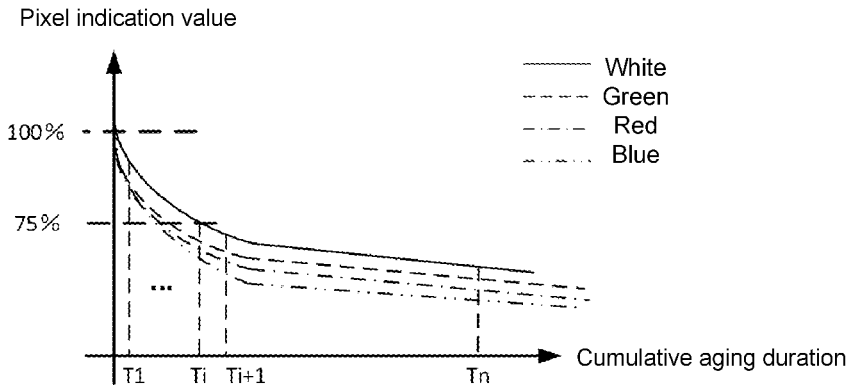
FIG. 9 is a schematic diagram of an aging model according to an exemplary embodiment.

The aging model may be characterized in various forms, for example, a table form or a graphical form. As an example, the aging model may be characterized by a graph, in which in a case of a specified pixel value, the abscissa is a cumulative aging duration, and the ordinate is a pixel indication value. The graph may exhibit a change trend of a pixel indication value of a color sub-pixel point as the cumulative aging duration increases. It should be illustrated that when the aging model for each color is characterized by a graph, the aging models for different colors may be an overall aging model. For example, an overall aging model for red, green, blue, and white sub-pixels is shown with reference to FIG. 9, and the overall aging model is used for one type of display screen having a four-color (red, green, blue, and white) pixel structure.

The above specified pixel value may be set according to specific scenarios. In some embodiments, the aging model may be established by software simulation. In some other embodiments, the aging model may be established by laboratory experiments. When the specified pixel value is a luminance value, the larger the luminance value of the display device, the faster the aging of the display device. Therefore, if the aging model is established by laboratory experiments, in a case of a large luminance value, the aging model may be established rapidly. Therefore, in this scenario, in order to speed up the establishment of the aging model, the luminance value may be set to a high value, for example, the luminance value is in a range of 6000-10000 nits.

If a respective aging model is established for each display screen, and the respective aging model has the same initial pixel value as that of the display screen, the conversion process may be omitted, and the actual aging duration of the display screen is a cumulative aging duration of the display screen in the respective aging model.

Assuming that the display apparatus has a different initial pixel value from that of the aging model, the aging duration of the display screen may be determined according to the target sampling data, and the aging duration may be determined in various manners.

For example, the display apparatus is provided with a timer for obtaining a cumulative historical lighting duration. The display apparatus may determine the cumulative historical lighting duration as the actual aging duration of the display screen, and carry the actual aging duration of the display screen in the report data. The compensation apparatus may acquire the actual aging duration in the report data, and convert the actual aging duration into the aging duration of the display screen based on the target sampling data.

The actual aging duration may be characterized by actual cumulative aging durations of specified sub-pixel points on the display screen, wherein the specified sub-pixel points are located at the same positions as those of the sampled sub-pixel points of each frame of image in the above target sampling data. For example, the display apparatus may be configured with a timer for each specified sub-pixel point, to record a historical lighting duration of the specified sub-pixel point, determine the historical lighting duration as an actual cumulative aging duration of the specified sub-pixel point, and carry actual cumulative aging durations of various specified sub-pixel points in report data, and the compensation apparatus may acquire the actual cumulative aging durations of various specified sub-pixel points in the report data, and convert the actual aging durations into cumulative aging durations of various specified sub-pixel points based on the target sampling data.

As an example, the above conversion process may be implemented using a look-up table. For example, a look-up table of pixel values, actual cumulative aging durations, and cumulative aging durations suitable for aging models may be pre-established. For each of the specified sub-pixel points, a predicted pixel value of the specified sub-pixel point may be determined, wherein the predicted pixel value may be a weighted value or average value of all pixel points in the target sampling data which are located at the same position as that of the specified sub-pixel point; and then a cumulative aging duration of the specified sub-pixel point suitable for an aging model may be obtained by querying the look-up table using the predicted pixel value of the specified sub-pixel point and an actual lighting duration (i.e., an actual cumulative aging duration).

As another example, the cumulative aging duration may be characterized by cumulative aging durations of the specified sub-pixel points on the display screen. The compensation apparatus determines an aging model which matches a color of each specified sub-pixel point among aging models for different colors as an aging model for the specified sub-pixel point; and then determine a cumulative aging duration of the specified sub-pixel point in the display screen based on pixel values of all sub-pixel points which are located at the same position as that of the specified sub-pixel point in the target sampling data, wherein various specified sub-pixel points are located at the same positions as those of sub-pixel points of w pixel points in each of the m regions, and cumulative aging durations of the specified sub-pixel points are cumulative aging durations of the specified sub-pixel points in respective aging models.

For example, the cumulative aging duration t of each specified sub-pixel point may be calculated by the following formula: $t=t1+t2+t3$, where t1 is an aging duration of the specified sub-pixel point in currently acquired target sampling data, t2 is an aging duration of the specified sub-pixel point in historical target sampling data, and t3 is an aging duration of the specified sub-pixel point obtained based on a total sampling interval duration.

The aging duration of the specified sub-pixel point in each of the currently acquired target sampling data and the historical target sampling data is: a sum of aging durations of sub-pixel points of all frames of image which are located at the same position as that of the specified sub-pixel point in the target sampling data, or a sum of weighted values of cumulative aging durations of the sub-pixel points of all frames of image which are located at the same position as that of the specified sub-pixel point in the target sampling data. Here, the compensation apparatus determines and records an aging duration of each specified sub-pixel point based on target sampling data transmitted by the display apparatus each time the compensation apparatus acquires the target sampling data. The so-called historical target sampling data is target sampling data which is received before the currently received target sampling data is received. For example, if four target sampling data transmitted by the display apparatus is received before the currently received target sampling data is received, the historical target sampling data is the four target sampling data.

The total sampling interval duration may be determined according to the sampling manner of the display apparatus in step 401. In case the display apparatus samples pixel values of a plurality of continuous frames of image to be displayed on the display screen, that is, two sampled frames of image are sampled without time interval, the total duration of sampling interval(s) is 0, and accordingly, t3 is also 0. When the display apparatus samples pixel values of at least one frame of image every a specified number of frames after the display screen is lit, a total number v of samplings in the currently acquired target sampling data and the historical target sampling data and a sampling interval t4 may be determined, where v is a positive integer. In this case, the total duration of the sampling intervals is $t5=v*t4$, and $t3=f(t5)$, wherein f( ) is a preset time mapping relationship function, which is used to map a total duration of sampling interval(s) to an aging duration of the specified sub-pixel point, and f( ) may be a linear function or a non-linear function, which is not limited in the embodiments of the present disclosure.

In some embodiments, the aging duration may be determined by interpolation according to the sampling interval. For example, for a specified sub-pixel point, the aging duration may be calculated by linear interpolation according to the sampling interval between each two adjacent target sampling data. The aging duration of the specified sub-pixel point for the total duration of sampling interval(s) may be determined as a sum of aging durations of the specified sub-pixel point for all sampling intervals. For example, the linear interpolation process comprises: performing linear interpolation based on an aging duration of the specified sub-pixel point in a last frame in the target sampling data obtained by a former one of two adjacent samplings and an aging duration of the specified sub-pixel point in a first frame in the target sampling data obtained by a latter one of the two adjacent samplings, to obtain an aging duration of the specified sub-pixel point for a sampling interval between the two adjacent samplings.

Assuming that the aging duration of the specified sub-pixel point in each target sampling data is a sum of aging durations of sub-pixel points which are located at the same position as that of the specified sub-pixel point in all frames of image in the target sampling data, the aging duration of the specified sub-pixel point in one target sampling data may be determined in the following manner.

In step Y1, for each sampled sub-pixel point in each of the at least one frame of image in the target sampling data, the compensation apparatus obtains a scaling factor for a pixel value of the sub-pixel point by querying a look-up table of pixel values and scaling factors.

The compensation apparatus may store the look-up table of pixel values and scaling factors in advance. The scaling factors are configured in consideration of factors such as material properties of the display device etc. according to a relationship between the pixel values of various sub-pixels of pixel points of the display screen and the specified pixel values (aging parameters) of the aging models. A lighting duration of a pixel point (or a sub-pixel point) may be converted into a cumulative aging duration suitable for a selected aging model using the scaling factor. For example, the compensation apparatus stores a first look-up table which records the relationship between pixel values and scaling factors in advance, and queries the first look-up table to obtain a scaling factor for a pixel value of each sampled sub-pixel point in each of the at least one frame of image.

Since the above scaling factor is used to reflect material properties of the display device, the scaling factor may be positively correlated with the pixel value, that is, the larger the pixel value, the larger the respective scaling factor. For example, the pixel value may be a grayscale value or a luminance value.

In step Y2, the compensation apparatus determines a product of a scaling factor for a pixel value of each sampled sub-pixel point in each frame of image and a cumulative lighting duration of the sampled sub-pixel point as an aging duration of the sub-pixel point in the frame of image in the target sampling data.

In an optional implementation, the target sampling data is obtained through sampling, by the display apparatus, pixel values of a plurality of continuous frames to be displayed on the display screen. The cumulative lighting duration for each frame is a frame display duration, which refers to a unit display duration of one frame of image, and is related to a display format or a refresh rate of the display screen. The frame display duration is usually a fixed duration. For example, if the display screen displays 48 frames in 1 second, the frame display duration is $1/48$ seconds.

For example, if a pixel value of a certain sub-pixel point has a scaling factor of 0.25, and the frame display duration is $1/48$ seconds, an aging duration of the certain sub-pixel point in the target sampling data is 0.25/48 seconds.

In another optional implementation, when the target sampling data is obtained through sampling, by the display apparatus, pixel values of one frame every u frames to be displayed on the display screen, the display duration is u+1 frame display durations. For example, if u=10, and the display screen displays 48 frames in 1 second, the frame display duration is ¼8 seconds. Further, for example, if a scaling factor for a pixel value of a certain sub-pixel point is 0.25, since the frame display time is ¼8 seconds, an aging duration of the sub-pixel point is 0.25×(¼8×11) seconds.

It should be illustrated that the above display duration may also be calculated in other manners, which will not be described in detail again in the embodiments of the present disclosure.

In step Y3, the compensation apparatus calculates a sum of aging durations of sub-pixel points which are located at the same position in all the images in the target sampling data as the aging duration of the respective sub-pixel point.

It should be illustrated that the plurality of aging models in the above step 403 refer to the same type of multiple aging models established for the same batch of display screens, and the display apparatus refers to a display apparatus using the batch of display screens. In this application scenario, the compensation apparatus may be a dedicated compensation apparatus for the same batch of display screens, and the aging models stored by the compensation apparatus are used for the same batch of display screens. In a practical implementation, the compensation apparatus may also store multiple types of aging models established for different batches of display screens, and each type of aging models comprises a plurality of aging models. In this application scenario, the target sampling data may carry a batch number of a display screen in display apparatus, and after receiving each target sampling data, the compensation apparatus may query a relationship between batch numbers and aging models to determine an aging model for the batch number in the target sampling data, and then perform the above step 403.

In step 404, the compensation apparatus determines pixel compensation data based on the aging duration of the display screen.

For example, the compensation apparatus determines the pixel compensation data by querying the aging model. In some embodiments, the pixel compensation data may comprise an overall adjustment factor for one frame of image. In some other embodiments, the pixel compensation data may comprise an adjustment factor for each of a plurality of regions of one frame of image. For example, in a case where the target sampling data is obtained through regional sampling, the target sampling data comprises sampling data in m regions in each of at least one frame of image, sampling data in each region comprises pixel values of w pixel points, and a pixel value of each pixel point comprises pixel values of a plurality of sub-pixel points having different colors. Accordingly, the determined pixel compensation data comprises m groups of adjustment factors in one-to-one correspondence to the m regions, each group of adjustment factors is used for adjusting pixel values of a respective region in the target frame image, and comprises adjustment factors for n pixel points, where n is a positive integer, and an adjustment factor for each pixel point comprises adjustment factors for a plurality of sub-pixel points having different colors.

Figure 10:
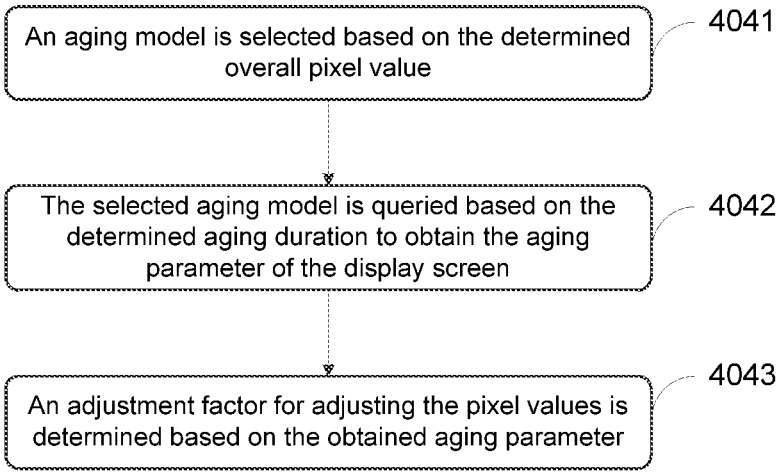
FIG. 10 is a flowchart of a process of determining pixel compensation data according to an exemplary embodiment.

FIG. 10 is a flowchart of a process of determining pixel compensation data according to an exemplary embodiment.

In step 4041, an aging model is selected based on the determined overall pixel value. For example, an aging model which matches the overall pixel value may be selected based on the overall pixel value. The aging model may be used to determine an overall aging parameter for the display screen. In some embodiments, an overall pixel value may be determined for each of a plurality of regions of the display screen and a respective aging models may be selected for the region, wherein each aging model is used to determine an aging parameter for a respective region.

In step 4042, the selected aging model is queried based on the determined aging duration to obtain the aging parameter of the display screen.

For example, the respective aging model may be queried based on the overall aging duration of the display screen to obtain the overall aging parameter for the display screen. In some embodiments, the compensation apparatus may query an aging model of each specified sub-pixel point using a cumulative aging duration of the specified sub-pixel point to obtain a pixel indication value (also referred to as an aging parameter) for the specified sub-pixel point, which is used to indicate a percentage of reduction in pixel value (for example, luminance value).

For example, assuming that a certain specified sub-pixel point is a specified white sub-pixel point, and an aging model of the specified white sub-pixel point is the aging model shown in FIG. 7, a pixel indication value of the specified white sub-pixel point obtained is 75% when a cumulative aging duration of the specified white sub-pixel point is Ti.

In step 4043, an adjustment factor for adjusting the pixel values is determined based on the obtained aging parameter.

For example, an overall adjustment factor for the display screen may be determined based on the overall aging parameter of the display screen, so that pixel values of all the pixel points in one frame of image are adjusted using the adjustment factor in a subsequent step 405. In some embodiments, the compensation apparatus may determine an adjustment factor for each specified sub-pixel point based on a pixel indication value (i.e., an aging parameter) for the specified sub-pixel point. The compensation apparatus may store a relationship between pixel indication values and adjustment factors in advance. The adjustment factor is configured in consideration of factors such as material properties of the display device etc. according to a relationship between degrees of aging of the display device and degrees of compensation for the display device. For example, the compensation apparatus stores a second look-up table which records a relationship between pixel indication values and adjustment factors in advance, and queries the second look-up table according to the pixel indication value to obtain an adjustment factor of each sub-pixel point. In an optional case, the adjustment factor is used to characterize a proportional relationship between pixel values of a pixel point to be compensated in a case of a certain degree of aging of the display device and pixel values of the pixel point in an initial state, and may have a value ranges from 0 to 1. In another optional case, the adjustment factor is used to characterize a proportional relationship between target pixel values (i.e., compensated pixel values) of a pixel point in a case of a certain degree of aging of the display device and pixel values of the pixel point in an initial state, and may have a value exceeding 1.

In some embodiments, the compensation apparatus may determine m groups of adjustment factors for m regions respectively based on adjustment factors for various specified sub-pixel points. The compensation apparatus may group the adjustment factors for various specified sub-pixel points according to regions to which the specified sub-pixel points belong, to obtain m groups of adjustment factors. Accordingly, if there are w sampled pixel points in each region in the sampling phase of step 401, each group of adjustment factors comprises adjustment factors for the w pixel points, that is, adjustment factors for a plurality of sub-pixel points of the w pixel points. For example, if there is one sampled pixel point in each region, and a pixel structure of the pixel point is a three-color (red, green, and blue) pixel structure, each group of adjustment factors comprises adjustment factors for one pixel point, that is, an adjustment factor for a red sub-pixel point, an adjustment factor for a green sub-pixel point, and an adjustment factor for a blue sub-pixel point.

As an example, the compensation apparatus may use m groups of adjustment factors for m regions as the pixel compensation data. As another example, the compensation apparatus detects a number of adjustment factors for pixel points in each group of adjustment factors. When each group of adjustment factors comprises adjustment factors for one pixel point, the compensation apparatus may use the m groups of adjustment factors as the pixel compensation data; and when each group of adjustment factors comprises adjustment factors for a plurality of pixel points, the compensation apparatus may integrate each group of adjustment factors into an adjustment factor for one pixel point, and the integrated adjustment factors for m pixel points are used as the pixel compensation data. In this way, on the one hand, the overall data amount of the pixel compensation data is reduced, and on the other hand, when each group of adjustment factors in the pixel compensation data comprises an adjustment factor for one pixel point, the complexity of the pixel compensation of the display apparatus may be reduced, thereby improving the speed of compensation. For example, a plurality of adjustment factors in each group of adjustment factors may be integrated in at least one of the following manners: calculating an average value of a plurality of adjustment factors in each group of adjustment factors as an integrated adjustment factor; calculating a weighted average value of a plurality of adjustment factors in each group of adjustment factors as an integrated adjustment factor; and extracting any adjustment factor or an adjustment factor for a pixel point at a preset position from a plurality of adjustment factors in each group of adjustment factors as an integrated adjustment factor.

In a case where the target sampling data is obtained through non-regional sampling, the target sampling data may actually be regarded as being obtained through regional sampling when m=1.

As an example, the obtained target sampling data may comprise sampling data of all pixel points in each of at least one frame of image, and the respective pixel compensation data may comprise adjustment factors for all pixel points in one frame of image, wherein an adjustment factor for each pixel point comprises adjustment factors for a plurality of sub-pixel points having different colors. In this case, m=1 may be set, and the specified sub-pixel points are sub-pixel points located at the same positions as those of all sub-pixel points of one frame of image, and adjustment factors for all the pixel points may be calculated using the above steps 4041 to 4043.

As another example, the target sampling data may comprise sampling data of g pixel points in each frame of image, and the respective pixel compensation data may comprise adjustment factors for n pixel points, wherein g and n are optionally positive integers. When n=g, m=1 may be set, and adjustment factors for the n pixel points are calculated using the above steps 4041 to 4042; and when n=1, m=1 may be set, and an adjustment factor for one pixel point is calculated using the above steps 4041 to 4043.

In some other embodiments, the compensation apparatus may store a machine learning model for determining an adjustment factor based on input target sampling data. Then, the compensation apparatus may input the target sampling data into the machine learning model to obtain an adjustment factor. For example, the machine learning model may be trained by the compensation apparatus or other apparatuses. The training process may comprise: pre-establishing a sample set comprising sampling data for different aging durations and adjustment factors for various sampling data; and training the machine learning model using the sample set to obtain a machine learning model for determining an adjustment factor.

In a case where the target sampling data is obtained through regional sampling, the adjustment factor output by the machine learning model may comprise adjustment factors for various specified pixel points, and the compensation apparatus may determine m groups of adjustment factors in the same manner as the above step 4043. Alternatively, the adjustment factor output by the machine learning model may be m groups of adjustment factors. In a case where the target sampling data is obtained through non-regional sampling, the adjustment factor output by the machine learning model may comprise adjustment factors for n pixel points, wherein n is optionally a positive integer or n=1; or comprises adjustment factors for all pixel points in one frame of image.

It should be illustrated that, in a case where the target sampling data is obtained through regional sampling, the compensation apparatus may determine a region to which each pixel point in the sampling data belongs in advance in various manners in determining the pixel compensation data. As an example, the report data may comprise information on a region to which each sampled pixel point in each frame of image of the target sampling data belongs. The compensation apparatus may extract the information on the region to which each sampled pixel point in each frame of image belongs from the report data. As another example, the compensation apparatus and the display apparatus pre-agree on a region partitioning manner and a sampling manner in each region, wherein the region partitioning manner may be the partitioning manner in the above step 4011, and the sampling manner may be known with reference to the sampling manner in the above step 4012. After receiving the report data, the compensation apparatus may determine, based on to the pre-agreed region partitioning manner and the sampling manner in each region, information on a region to which each sampled pixel point in each frame of image of the target sampling data belongs.

In step 405, the compensation apparatus transmits the pixel compensation data to the display apparatus.

The compensation apparatus may transmit the pixel compensation data to the display apparatus through a wireless network.

The compensation apparatus may transmit the pixel compensation data to the display apparatus in real time. In some embodiments, in consideration of a slow aging process of the display devices of the display screen of the display apparatus, the compensation apparatus may periodically transmit the pixel compensation data, that is, the compensation apparatus may transmit the pixel compensation data once per issuing period. For example, the issuing period may be one day, two days or seven days, etc., as long as the issuing period is less than a cumulative aging duration of the display device, which is not limited in the embodiments of the present disclosure.

In step 406, after receiving the pixel compensation data transmitted by the compensation apparatus, the display apparatus performs pixel compensation on the target frame image to be displayed on the display screen based on the pixel compensation data.

Referring to the above step 404, since there are various types of compensation data, there are various processes for the display apparatus to perform pixel compensation.

For example, when the target sampling data is obtained by partition sampling, the pixel compensation data comprises m groups of adjustment factors in one-to-one correspondence to m regions, each group of adjustment factors comprises adjustment factors for n pixel points, where n is a positive integer, and an adjustment factor for each pixel point comprises adjustment factors for a plurality of sub-pixel points having different colors. After receiving the pixel compensation data transmitted by the compensation apparatus, the display apparatus compensates for the target frame image based on the pixel compensation data.

Figure 11:
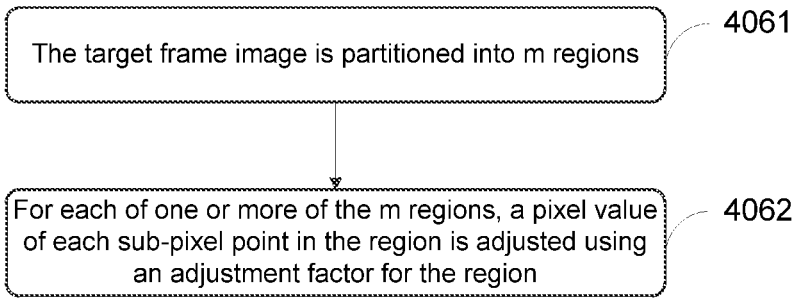
FIG. 11 is a flowchart of a process of performing pixel compensation based on compensation data according to an exemplary embodiment.

FIG. 11 is a flowchart of a process of performing pixel compensation based on compensation data according to an exemplary embodiment.

In step 4061, the display apparatus partitions the target frame image into m regions in a specified partitioning manner.

The specified partitioning manner is the same as that in the above step 4011, and will not be described in detail again in the embodiments of the present disclosure.

In step 4062, for each of one or more of the m regions, a pixel value of each sub-pixel point in the region is adjusted using an adjustment factor for the region.

Although the above description has been made by way of example of regional compensation, the embodiments of the present disclosure are not limited thereto, and other compensation manners may be used as needed. For example, in a case where the pixel compensation data comprises an overall adjustment factor for the display screen, a pixel value of each pixel point in each frame of image may be adjusted using the adjustment factor. In some embodiments, the target sampling data comprises pixel values for sub-pixel points of different colors, and accordingly, the pixel compensation data comprises an adjustment factor for sub-pixel points of each color, in which case pixel values of sub-pixel points of each color in each frame of image may be adjusted using an adjustment factor for that color. In some other embodiments, the pixel compensation data may comprise adjustment factors for m regions, and pixel values of some or all of pixel points in each region of each frame of image may be adjusted based on a respective adjustment factor, wherein any one or more of the m regions may be used as regions to be adjusted.

When each group of adjustment factors comprises an adjustment factor for one pixel point, that is, n=1, the display apparatus may determine, as a target adjustment factor, adjustment factors for respective color sub-pixel points in the group of adjustment factors of the region.

When each group of adjustment factors comprises adjustment factors for a plurality of pixel points, that is, n is greater than 1, the display apparatus may integrate each group of adjustment factors, so that each integrated group of adjustment factors comprises an adjustment factor for one pixel point, and then determine, as a target adjustment factor, adjustment factors for respective color sub-pixel points in the group of adjustment factors of the region.

For example, each group of adjustment factors may be integrated in any of the following manners: calculating an average value of adjustment factors for a plurality of pixel points in a group as an integrated adjustment factor; calculating a weighted average value of adjustment factors for a plurality of pixel points in a group as an integrated adjustment factor; and calculating an adjustment factor for any pixel point or an adjustment factor for a pixel point at a preset position from adjustment factors for a plurality of pixel points in a group as an integrated adjustment factor.

In a case where the target sampling data is obtained through non-regional sampling, the display apparatus may acquire a target adjustment factor for each sub-pixel point in the target frame image based on the pixel compensation data, and adjust a pixel value of each sub-pixel point using the target adjustment factor for the sub-pixel point.

For example, the pixel compensation data may comprise adjustment factors for n pixel points, where n is a positive integer. When n=1, an adjustment factor for a sub-pixel point having the same color as that of each sub-pixel point among adjustment factors for one pixel point is determined as the target adjustment factor; and when n is greater than 1, the display apparatus may integrate adjustment factors for n pixel points to obtain adjustment factors for one pixel point, and then determine an adjustment factor for a sub-pixel point having the same color as that of each sub-pixel point among adjustment factors for one pixel point as the target adjustment factor. The integration process may be known with reference to the above process of integrating adjustment factors for pixel points in one group of adjustment factors, and will not be described in detail again in the embodiments of the present disclosure.

In some embodiments, the pixel compensation data may comprise adjustment factors for all pixel points in one frame of image, and an adjustment factor for each pixel point comprises adjustment factors for a plurality of sub-pixel points having different colors. In this case, the display apparatus may determine, as a target adjustment factor, an adjustment factor for a sub-pixel point which is located at the same position as that of each sub-pixel point in the target frame image and has the same color as that of the sub-pixel point in the pixel compensation data.

When the compensation is performed, a pixel value of each sub-pixel point may be adjusted using a target adjustment factor for the sub-pixel point.

For example, when the adjustment factor is used to characterize a proportional relationship between pixel values of a pixel point to be compensated in a case of a certain degree of aging of a display device and pixel values of the pixel point in an initial state, the display apparatus may calculate an adjusted pixel value of each sub-pixel point using a compensation formula of $Q'=(1+a)\times Q$, where a is a target adjustment factor for any sub-pixel point in the target frame image, Q is a pixel value of the sub-pixel point in the target frame image, and Q' is an adjusted pixel value of the sub-pixel point in the target frame image.

In some embodiments, when the adjustment factor is used to characterize a proportional relationship between target pixel values (i.e., compensated pixel values) of a pixel point in a case of a certain degree of aging of a display device and pixel values of the pixel point in an initial state, the display apparatus may determine a product of a pixel value of each sub-pixel point and an adjustment factor for the sub-pixel point as an adjusted pixel value of the sub-pixel point.

For example, assuming that a pixel value of a certain pixel point is a grayscale value of 350, and a target adjustment factor is 1.5, a target grayscale value of the certain pixel point is $350\times1.5=525$. If the target grayscale value exceeds the highest grayscale value of the display screen, the target grayscale value of the certain pixel point is the highest grayscale value. If the target grayscale value does not exceed the highest grayscale value of the display screen, the target grayscale value of the certain pixel point is 525.

It should be illustrated that, for different types of display apparatuses, the reported target sampling data may have different content. Referring to the above step 402, in an optional implementation, after acquiring target sampling data, the display apparatus may report the target sampling data, and in another optional implementation, after acquiring target sampling data, the display apparatus may update the target sampling data according to a display condition of the display screen itself, so that the updated target sampling data is more suitable for actual display effects, which may improve the accuracy of the pixel compensation data to be subsequently determined. By taking the display screen of the display apparatus being an OLED display screen as an example, assuming that the pixel value is a grayscale value, before the above step 403, a process of updating the target sampling data may also be performed in the following manner.

In step A1, for each of at least one frame of image, a target pixel value of the frame of image is determined based on APL of the frame of image.

When the OLED display screen displays an image, a target luminance range of an OLED may be obtained using a peak luminance algorithm, and final display data of the image is determined according to APL of the currently displayed image. Therefore, the display apparatus queries a relationship between APL of various frames and target luminance according to the APL of each of the at least one frame of image to obtain target luminance of the frame of image.

In step A2, a mapping of specified pixel value intervals to gain values is queried based on the target pixel value of each frame of image to determine a gain value. In the mapping, the pixel value intervals may be proportional to the gain values, for example, a higher pixel value interval is mapped to a larger gain value, and a lower pixel value interval is mapped to a smaller gain value.

The pixel value intervals are obtained by dividing the target pixel value range, and the more the number of the divided pixel value intervals is obtained, the more accurate the gain values are. Specifically, the target pixel value range may be divided linearly, or may be divided non-linearly according to practical conditions. For example, the target luminance range may be divided into more luminance intervals for the value range of the APL, so that a more accurate gain is obtained by querying the target luminance for the target luminance range.

The luminance intervals may be proportional to the gain values. For example, assuming that there are X luminance intervals, the X luminance intervals are a first luminance interval to an $X^{th}$ luminance interval in an order of magnitude of luminance, and a gain value for an $i^{th}$ interval is i/X, where $1 \leq i \leq X$.

For example, assuming that the target luminance range is 0-600 nits, and the target luminance range is divided into six luminance intervals which are 0-100 nits, 101-200 nits, 201-300 nits, 301-400 nits, 401-500 nit, and 501-600 nits respectively in an order of magnitude of luminance, respective gain values are ⅙, ⅓, ½, ⅔, ⅚ and 1.

Since the target luminance range is divided into luminance intervals, a data amount of the gain values is reduced.

In step A3, a gain value, to which a pixel value interval where each target pixel value is located is mapped, is determined as a target gain value for each frame of image.

For example, the display apparatus may determine a luminance interval to which target luminance belongs according to the target luminance, and determine a gain value for the luminance interval as a target gain value for each of the at least one frame of image. By taking the above step A2 as an example, assuming that target luminance of a certain frame of image is 600 nits, a luminance interval where the target luminance is located is 501-600 nits, and a target gain value for the certain frame of image is 1; assuming that target luminance of a certain frame of image is 240 nits, a luminance interval where the target luminance is located is 201-300 nits, and a target gain value for the certain frame of image is ½; and assuming that target luminance of a certain frame of image is 80 nits, a luminance interval where the target luminance is located is 0-100 nits, and a target gain value for the certain frame of image is ⅙.

In step A4, a product of each sampled pixel value of each frame of image and a respective target gain value is included in the target sampling data as a sampled gain value. In the present embodiment, the pixel value may be a luminance value.

A respective target gain value of each sampled pixel value of each frame of image refers to a target gain value of an image where the pixel value is located. Since the target gain value for each frame of image may reflect a relationship between various pixel values of the frame of image to be displayed and actual display pixel values, a target pixel value of each sampled pixel point of each frame of image is determined as the actual display pixel value of the sampled pixel point.

In some embodiments, the display apparatus may also determine products of various pixel values of each frame of image and respective target gain values as target pixel values for various pixel values of the frame of image, and then choose a target pixel value for each sampled pixel value from the target pixel values.

In step A5, all the target pixel values are included in the target sampling data as sampled pixel values.

It should be illustrated that a sequence of steps of the pixel compensation method according to the embodiment of the present disclosure may be appropriately adjusted, and steps may also be added or removed accordingly according to situations.

In summary, with the pixel compensation method according to the embodiment of the present disclosure, since the compensation apparatus may determine the pixel compensation data based on report data from the display apparatus, and the display apparatus performs pixel compensation on the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

Figure 12:
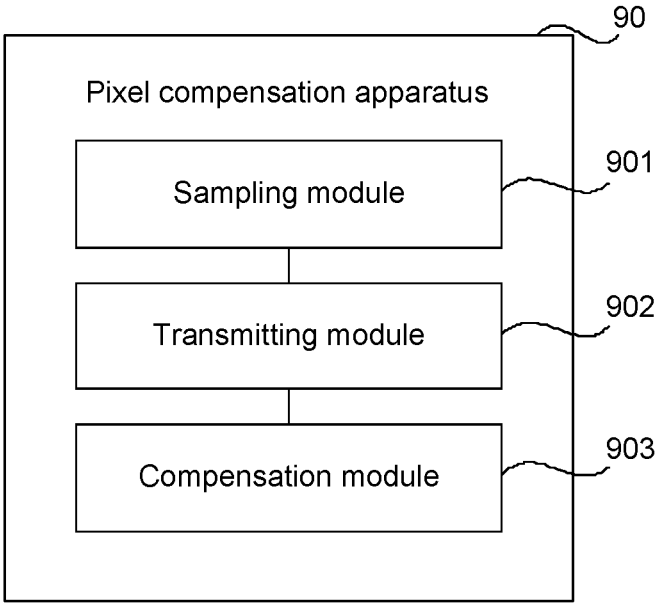
FIG. 12 is a block diagram of a pixel compensation apparatus according to an exemplary embodiment.

FIG. 12 is a block diagram of a pixel compensation apparatus according to an exemplary embodiment. As shown in FIG. 12, the embodiments of the present disclosure provide a pixel compensation apparatus 90 applied to a display apparatus having a display screen. The apparatus 90 comprises a sampling module 901, a transmitting module 902, and a compensation module 903.

The sampling module 901 is configured to sample pixel values of at least one frame of image to be displayed on the display screen to obtain target sampling data.

The transmitting module 902 is configured to transmit report data comprising the target sampling data to the compensation apparatus, wherein the report data is used by the compensation apparatus to determine an aging duration of the display screen based on the target sampling data and then determine pixel compensation data based on the aging duration.

The compensation module 903 is configured to, after receiving the pixel compensation data transmitted by the compensation apparatus, perform pixel compensation on a target frame image to be displayed on the display screen based on the pixel compensation data.

In summary, with the pixel compensation apparatus according to the embodiment of the present disclosure, since the pixel compensation apparatus of the display apparatus may transmit the target sampling data to the compensation apparatus, the compensation apparatus obtains the pixel compensation data based on the target sampling data, and the pixel compensation apparatus of the display apparatus performs pixel compensation on the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

In some embodiments, the sampling module 901 may be configured to partition each of the at least one frame of image into m regions in a specified partitioning manner, where m is a positive integer, and sample pixel points in each region of each frame of image, to obtain the target sampling data. The target sampling data comprises sampling data in m regions of each of the at least one frame of image, and sampling data in each region comprises pixel values of w pixel points, where w is a positive integer.

In the target sampling data, a pixel value of each pixel point comprises pixel values of a plurality of sub-pixel points having different colors. The pixel compensation data comprises m groups of adjustment factors in one-to-one correspondence to the m regions, each group of adjustment factors comprises adjustment factors for n pixel points, and an adjustment factor for each pixel point comprises adjustment factors for a plurality of sub-pixel points having different colors, where n is a positive integer.

The compensation module 903 may be configured to partition the target frame image into m regions in a specified partitioning manner, and for each sub-pixel point in a first region, a pixel value of the sub-pixel point is adjusted using a target adjustment factor for the sub-pixel point, wherein a target adjustment factor for any sub-pixel point is an adjustment factor determined based on an adjustment factor for the same color as that of the sub-pixel point among a group of adjustment factors for a region where the sub-pixel point is located, and the region where the sub-pixel point is located may be any of the m regions.

The display screen may be an Organic Light Emitting Diode (OLED) display screen, and the pixel values may be luminance values or grayscale values.

In some embodiments, the pixel compensation apparatus may further comprise a first determination module, a second determination module, a third determination module, and a query module.

The first determination module is configured to, before the target sampling data is transmitted to the compensation apparatus, determine, for each of the at least one frame of image, target luminance of each frame of image based on Average Pixel Luminance (APL) of the frame of image.

The query module is configured to query a mapping of specified luminance intervals to gain values based on target luminance of each frame of image, wherein the luminance intervals are positively correlated with the gain values in the mapping.

The second determination module is configured to determine a gain value to which a luminance interval where each target luminance is located is mapped as a target gain value for each frame of image.

The third determination module is configured to determine a product of each sampled grayscale value of each frame of image and a respective target gain value as a target grayscale value of the sampled grayscale value of the frame of image.

An update module is configured to update the target sampling data with all target grayscale values.

In summary, with the pixel compensation apparatus according to the embodiment of the present disclosure, since the pixel compensation apparatus of the display apparatus may transmit the target sampling data to the compensation apparatus, the compensation apparatus obtains the pixel compensation data according to the target sampling data, and the pixel compensation apparatus of the display apparatus performs pixel compensation on the target frame of image to be displayed based on the pixel compensation data, thereby realizing compensation for the aging of the display screen of the display apparatus, improving the display uniformity of the aged display screen, and reducing display problems such as afterimages etc. caused by the aging of the display screen.

Figure 13:
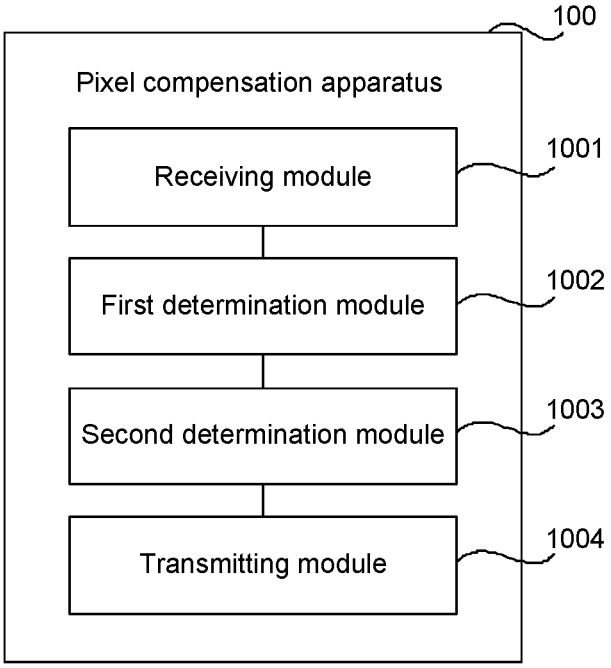
FIG. 13 is a block diagram of a pixel compensation apparatus according to an exemplary embodiment.

FIG. 13 is a block diagram of a pixel compensation apparatus according to an exemplary embodiment. As shown in FIG. 13, the embodiments of the present disclosure provide a pixel compensation apparatus 100 applied to a compensation apparatus. The apparatus 100 comprises a receiving module 1001, a first determination module 1002, a second determination module 1003, and a transmitting module 1004.

The receiving module 1001 is configured to receive report data comprising target sampling data transmitted by the display apparatus having a display screen, wherein the target sampling data is obtained through sampling, by the display apparatus, pixel values of at least one frame of image to be displayed on the display screen.

The first determination module 1002 is configured to determine an aging duration of the display screen based on the target sampling data.

The second determination module 1003 is configured to determine pixel compensation data based on the aging duration.

The transmitting module 1004 is configured to transmit the pixel compensation data to the display apparatus.

In summary, with the pixel compensation apparatus according to the embodiment of the present disclosure, since the pixel compensation apparatus of the compensation apparatus may determine the pixel compensation data according to the target sampling data reported by the display apparatus, and the display apparatus performs pixel compensation on the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

The target sampling data comprises sampling data in m regions in each of at least one frame of image, where m is a positive integer, sampling data in each region comprises pixel values of w pixel points, and a pixel value of each pixel point comprise pixel values of a plurality of sub-pixel points having different colors. The pixel compensation data comprises m groups of adjustment factors in one-to-one correspondence to the m regions, each group of adjustment factors comprises adjustment factors for n pixel points, and an adjustment factor for each pixel point comprises adjustment factors for a plurality of sub-pixel points having different colors, where n is a positive integer.

In some embodiments, the first determination module 1002 may be configured to determine an aging model of a sub-pixel point having the same color as that of each specified sub-pixel point among aging models for sub-pixel points of different color as an aging model for the specified sub-pixel point, and determine a cumulative aging duration of the specified sub-pixel point in the display screen based on pixel values of all sub-pixel points located at the same position as that of the specified sub-pixel point in the target sampling data. Each aging model is used to characterize a relationship between cumulative aging durations of a display device where a color sub-pixel point is located and pixel indication values of the sub-pixel point when an initial pixel value of the color sub-pixel point is a specified pixel value, wherein the pixel indication value is used to identify a pixel value after the aging.

The cumulative aging durations of specified sub-pixel points in the display screen are determined based on pixel values of all the sub-pixel points located at the same positions as those of the specified sub-pixel points in the target sampling data, the specified sub-pixel points are located at the same positions as sub-pixel points of w pixel points in each of the m regions, and the cumulative aging durations of the specified sub-pixel points are cumulative aging durations of the specified sub-pixel points in the respective aging models.

The second determination module 1003 may be configured to query an aging model of each specified sub-pixel point using a cumulative aging duration of the specified sub-pixel point, to obtain a pixel indication value of the specified sub-pixel point; determine an adjustment factor for each specified sub-pixel point based on the pixel indication value of the specified sub-pixel point; and determine m groups of adjustment factors based on adjustment factors for various specified sub-pixel points.

In summary, with the pixel compensation apparatus according to the embodiment of the present disclosure, since the pixel compensation apparatus of the display apparatus may transmit the target sampling data to the compensation apparatus, the compensation apparatus obtains the pixel compensation data based on the target sampling data, and the pixel compensation apparatus of the display apparatus performs pixel compensation on the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

With regard to the apparatus in the above embodiments, the specific manner in which the respective modules perform the operations has been described in detail in the method embodiments, and will not be explained in detail herein.

The embodiments of the present disclosure provide a pixel compensation apparatus comprising a processor and a memory storing instructions executable by the processor, wherein the instructions which, when executed by the processor, cause the processor to perform the pixel compensation method according to any of the above embodiments. For example, the pixel compensation apparatus may be implemented in the above display apparatus to implement the above method performed on the display apparatus side.

The embodiments of the present disclosure further provide a pixel compensation apparatus comprising a processor and a memory storing instructions executable by the processor, wherein the instructions which, when executed by the processor, cause the processor to perform the pixel compensation method according to any of the above embodiments. For example, the pixel compensation apparatus may be implemented in the above compensation apparatus to implement the above method performed on the compensation apparatus side.

The embodiments of the present disclosure provide a pixel compensation system comprising a display apparatus having a display screen and a compensation apparatus, wherein the display apparatus having the display screen may be configured to perform the pixel compensation method on the display apparatus side, and the compensation apparatus may be configured to perform the pixel compensation method on the compensation apparatus side. For example, the display apparatus having the display screen may comprise a first memory and a first processor, wherein the first memory has stored therein instructions executable by the first processor, wherein the instructions which, when executed by the first processor, cause the first processor to perform operations of: sampling pixel values of an image to be displayed on the display screen to obtain target sampling data; transmitting the target sampling data to the compensation apparatus; receiving pixel compensation data from the compensation apparatus, wherein the pixel compensation data is determined according to an aging duration of the display screen which is determined based on the target sampling data; and compensating for the pixel values of the image to be displayed on the display screen based on the pixel compensation data. The compensation apparatus may comprise a second memory and a second processor, wherein the second memory has stored therein instructions executable by the second processor, wherein the instructions which, when executed by the second processor, cause the second processor to perform operations of: receiving, from the display apparatus, the target sampling data obtained by sampling the pixel values of the image to be displayed on the display screen; determining the aging duration of the display screen based on the target sampling data; determining the pixel compensation data based on the aging duration; and transmitting the pixel compensation data to the display apparatus.

In summary, with the pixel compensation system according to the embodiment of the present disclosure, since the compensation apparatus may determine the pixel compensation data according to the report data from the display apparatus, and the display apparatus performs pixel compensation on the target frame image to be displayed based on the pixel compensation data, thereby realizing compensation for the aging of the display screen of the display apparatus, improving the display uniformity of the aged display screen, and reducing display problems such as afterimages etc. caused by the aging of the display screen.

It is to be understood that the present disclosure is not limited to the exact structures which have been described above and illustrated in the accompanying drawings, and various modifications and changes may be made without departing from the scope of the present disclosure. The scope of the present disclosure is merely defined by the appended claims.

We claim:

1. A pixel compensation method, comprising:

sampling pixel values of an image to be displayed on a display screen to obtain target sampling data;

transmitting the target sampling data;

receiving pixel compensation data, wherein the pixel compensation data is determined according to an aging duration of the display screen which is determined based on the target sampling data; and compensating for the pixel values of the image to be displayed on the display screen based on the pixel compensation data, wherein sampling pixel values of the image to be displayed on the display screen to obtain target sampling data comprises:

for at least one frame of the image to be displayed, partitioning each of the at least one frame of the image into m regions, where m is a positive integer; and sampling pixel values of at least a portion of pixel points in each of the regions of each frame of the image to obtain the target sampling data, and wherein before transmitting the target sampling data, the method further comprises:

for each of the at least one frame of the image, determining a target pixel value of the frame of the image based on Average Pixel Luminance (APL) of the frame of the image;

determining, based on a pre-established mapping of pixel value intervals to gain values, a gain value to which a pixel value interval where the target pixel value is located is mapped; and determining a product of each sampled pixel value of the frame of the image and the determined gain value as the sampled pixel value to be included in the target sampling data.

2. The method according to claim 1, wherein the pixel compensation data comprises an adjustment factor, and compensating for the pixel values of the image to be displayed on the display screen based on the pixel compensation data comprises: for at least one frame of the image to be displayed, adjusting pixel values of pixel points of each of the at least one frame of the image using the adjustment factor.

3. The method according to claim 1, wherein the target sampling data comprises pixel values of sub-pixel points of different colors, the pixel compensation data comprises an adjustment factor for sub-pixel points of each of the different colors, and compensating for the pixel values of the image to be displayed on the display screen based on the pixel compensation data comprises: for each of the at least one frame of the image to be displayed, adjusting pixel values of sub-pixel points of each color in the frame of the image by using a respective adjustment factor.

4. The method according to claim 1, further comprising: establishing a mapping of pixel value intervals to gain values by:

generating X pixel value intervals based on a highest pixel value of the image to be displayed, where X is an integer greater than 1; and mapping an $i^{th}$ one of the X pixel value intervals to a gain value of i/X, where i is an integer and $1<i<X$.

5. The method according to claim 1, wherein the display screen is an Organic Light Emitting Diode (OLED) display screen, and the pixel values are luminance values or gray-scale values.

6. A pixel compensation apparatus, comprising:

a processor; and a memory having stored therein instructions executable by the processor, wherein the instructions which, when executed by the processor, cause the processor to perform the pixel compensation method according to claim 1.

7. A pixel compensation method, comprising:

receiving target sampling data obtained by sampling pixel values of an image to be displayed on a display screen;

determining an aging duration of the display screen based on the target sampling data;

determining pixel compensation data based on the aging duration; and transmitting the pixel compensation data, wherein determining an aging duration of the display screen based on the target sampling data comprises:

determining an overall pixel value and a cumulative lighting duration of the sampled image based on the target sampling data; and determining the aging duration based on the overall pixel value and the cumulative lighting duration, and wherein determining the aging duration based on the overall pixel value and the cumulative lighting duration comprises:

selecting a scaling factor based on the determined overall pixel value; and converting, by using the scaling factor, the determined cumulative lighting duration into a value in a value range suitable for a selected aging model as the aging duration.

8. The method according to claim 7, wherein the target sampling data comprises pixel values sampled from m regions in each of at least one frame of the image to be displayed on the display screen and a sampling time for each of the at least one frame of the image, where m is a positive integer, and determining an overall pixel value and a cumulative lighting duration of the sampled image based on the target sampling data comprises:

determining an overall pixel value for each of the at least one frame of the image based on the pixel values sampled from the m regions of the frame of the image, and determining the overall pixel value of the sampled image based on the overall pixel values determined for the at least one frame of the image; and determining the cumulative lighting duration based on sampling times for the at least one frame of the image.

9. The method according to claim 8, wherein determining an overall pixel value for each of the at least one frame of the image based on the pixel values sampled from the m regions of the frame of the image comprises:

performing weighted averaging on the pixel values sampled from the m regions to obtain the overall pixel value for the frame of the image, wherein a weight of a region located at a center among the m regions is greater than that of a region located at an edge among the m regions.

10. The method according to claim 7, wherein determining pixel compensation data based on the aging duration comprises:

selecting an aging model based on the determined overall pixel value, wherein the aging model characterizes a relationship between aging durations and aging parameters for the determined overall pixel value;

querying the selected aging model based on the determined aging duration to obtain an aging parameter of the display screen; and determining an adjustment factor for adjusting the pixel values based on the obtained aging parameter.

11. The method according to claim 10, wherein the aging parameter represents a percentage of a decrease in pixel value.

12. The method according to claim 7, wherein the target sampling data comprises pixel values of sub-pixel points of different colors, and determining an aging duration of the display screen based on the target sampling data and determining pixel compensation data based on the aging duration are performed for sub-pixel points of each color.

13. The method according to claim 7, wherein the display screen is an Organic Light Emitting Diode (OLED) display screen, and the pixel values are luminance values or gray-scale values.

14. A pixel compensation apparatus, comprising:

a processor; and a memory having stored therein instructions executable by the processor, wherein the instructions which, when executed by the processor, cause the processor to perform the pixel compensation method according to claim 7.

15. A pixel compensation system, comprising a display apparatus having a display screen and a compensation apparatus, wherein:

the display apparatus having the display screen comprises a first memory and a first processor, wherein the first memory has stored therein first instructions executable by the first processor, wherein the first instructions which, when executed by the first processor, cause the first processor to perform operations of:

sampling pixel values of an image to be displayed on the display screen to obtain target sampling data;

transmitting the target sampling data to the compensation apparatus;

receiving pixel compensation data from the compensation apparatus, wherein the pixel compensation data is determined according to an aging duration of the display screen which is determined based on the target sampling data; and compensating for the pixel values of the image to be displayed on the display screen based on the pixel compensation data; and the compensation apparatus comprises a second memory and a second processor, wherein the second memory has stored therein second instructions executable by the second processor, wherein the second instructions which, when executed by the second processor, cause the second processor to perform operations of:

receiving, from the display apparatus, the target sampling data obtained by sampling the pixel values of the image to be displayed on the display screen;

determining the aging duration of the display screen based on the target sampling data;

determining the pixel compensation data based on the aging duration; and transmitting the pixel compensation data to the display apparatus.

* * * * *